US005249370A

United States Patent [19]

Stanger et al.

[11] Patent Number: 5,249,370

[45] Date of Patent: Oct. 5, 1993

[54] METHOD AND APPARATUS FOR FINGERPRINT IMAGE PROCESSING

[75] Inventors: Bruce N. Stanger, Norwood; Michael J. Miles, Victoria; Glenn M. Fishbine, Eden Prairie, all of Minn.

[73] Assignee: Digital Biometrics, Inc., Minnetonka, Minn.

[21] Appl. No.: 921,458

[22] Filed: Jul. 28, 1992

Related U.S. Application Data

[63] Continuation of Ser. No. 614,390, Nov. 15, 1990, abandoned.

[51] Int. Cl.[5] ..... F26B 3/00

[52] U.S. Cl. ..... 34/22; 34/202; 34/243 R; 34/90; 382/4; 427/1

[58] Field of Search ..... 34/243 R, 201, 202, 34/90, 91, 22, 224, 232; 427/1; 382/4, 5; 356/71; 118/31.5

[56] References Cited

U.S. PATENT DOCUMENTS

| | | | |
|---|---|---|---|
| 2,184,858 | 12/1939 | Goodman | 34/202 |
| 2,490,019 | 12/1949 | Elliot | 34/202 |
| 3,864,847 | 2/1975 | Friedman et al. | 34/202 |
| 4,206,556 | 6/1980 | Sabo et al. | 34/243 R |
| 4,322,163 | 3/1982 | Schiller | 356/71 |
| 4,701,959 | 10/1987 | Asai et al. | 382/4 |
| 4,999,929 | 3/1991 | Dutton | 34/202 |

*Primary Examiner*—Albert J. Makay
*Assistant Examiner*—Denise L. Gromada
*Attorney, Agent, or Firm*—Merchant, Gould, Smith, Edell, Welter & Schmidt

[57] ABSTRACT

A finger drying component for use with a finger print image processing apparatus is disclosed. The drying component removes moisture from the finger so that an unsmudged finger print can be imaged. A preferred embodiment involves the use of a forced air dryer to conduct a stream of air across the optical imaging surface.

15 Claims, 4 Drawing Sheets

METHOD AND APPARATUS FOR FINGERPRINT IMAGE PROCESSING

This is a continuation of application Ser. No. 07/614,390 filed Nov. 15, 1990, now abandoned.

BACKGROUND OF THE INVENTION

This invention relates generally to a fingerprint image processing apparatus, and more particularly to an apparatus and a method for removing moisture from contact surfaces of such apparatus, or from the finger of a subject to be imaged, or from both.

Originally, fingerprinting was done by inking a suspect's finger and applying the inked finger to paper. As can be readily understood, fingerprint information in this form was difficult to use. Making a fingerprint match was an extremely time-consuming task. Digital technology significantly advanced the art of fingerprinting. Inked images could be scanned, the image digitalized and recorded in a manner that could later be searched in a reasonably expeditious manner by computer. Problems arose, however, due to the quality of inked images. Over- and under-inking resulted in blurred or vague images, thus rendering the digitalized information useless. Further, the process of scanning an inked image was relatively time consuming.

These and other problems led to "live scanning." According to live scanning techniques, the fingerprint of a suspect is scanned directly from the suspect's finger, as opposed to being scanned from an inked image of the print. More specifically, live scans are those procedures which capture fingerprint ridge detail in a manner which allows for the immediate processing of the fingerprint image with a computer. Original work in the field dates back to original patents filed in 1964 concerning techniques used to capture high contrast images of fingerprint for photographic or digital capture of fingerprints.

Since their introduction, live scans have become an important tool for law-enforcement. The live scan has the potential to overcome inherent weaknesses in the ink capture of fingerprints. In particular, live scans are advantageous because they reduce over- or under-inking; reduce smudging or smearing; provide immediate transmission of fingerprint images; and allow for image enhancement if necessary.

These characteristics provide law-enforcement with the ability to improve the quality of the fingerprint data base, thereby improving the likelihood that identifications can be made either from latent fingerprints or from identity verification checks.

Fingerprint image processing systems have been disclosed in the literature and in patents. An example of one type of image processing system is shown in U.S. Pat. No. 4,322,163 to Schiller. Schiller '163 discloses an optical assembly for fingerprint image generation, which includes a reflective layer incorporated between a resilient layer and a flat glass base or platen. The force transmitted by a finger pressed against the back surface of this platen will cause the resilient layer to deform and provide a scannable image. Digital Biometrics, Inc. has recently published brochures describing an apparatus for obtaining a fingerprint image through a hard prism. Contact by a finger with a planar surface of the prism results in a high contrast image reflected onto sensor means for processing of the fingerprint image.

Generally, as can be understood from the discussion above, known fingerprint imaging apparatus and methods involve placement of one or more of the fingers of a human subject onto a surface which is then scanned to provide an image of the fingerprint. As can be readily understood, the process of being arrested can be particularly stressful, and it has been found that individuals often perspire while being fingerprinted. It has also been found that the presence of such perspiration, sweat or other moisture on the subject's finger or fingers, or on the contact surface, during image processing results in an image of reduced clarity. The image may, in fact, be so distorted as to be of little or no use in identification. More specifically, perspiration affects the dielectric surface properties of the finger. The effect is an optical, or electromagnetic phenomenon which distorts the fingerprint image.

Accordingly, it is an object of the present invention to provide a method and an apparatus suitable for removing such perspiration or other moisture from the finger or fingers of the subject, and/or from the contact surface itself.

SUMMARY OF THE INVENTION

This disclosure describes a fingerprint image processing apparatus, as well as a method for preparing a finger for fingerprint image processing.

The apparatus disclosed herein is a means for imaging having a contact surface that can receive one or more fingers thereon. As used herein, "means for imaging" refers to any apparatus, device or system useful for generation of a scanned fingerprint. The present means for imaging will have one or more surfaces, hereinafter referred to as "contact surfaces," upon which a human subject will place his or her finger or fingers for the purpose of scanning the image thereof. Typically, such contact surfaces will be formed from clear, non-absorbent materials such as glass, plastic, or a combination thereof. Moisture can accumulate on these non-absorbent contact surfaces, from the subject's finger, from the air, or elsewhere.

To alleviate this problem, the fingerprint image processing apparatus of the present invention also incorporates a drying arrangement. The drying arrangement is intended for the removal of the accumulated moisture such as perspiration or sweat from the contact surface, or from the finger itself, or from both the contact surface and the finger. In order to be effective at removing moisture from the contact surface, the drying arrangement will be positioned in proximity therewith.

Although it is contemplated that any suitable means known to those of ordinary skill in the art for removing moisture from surfaces may be used as a drying arrangement of the present apparatus, a preferred drying arrangement includes a device or mechanism for generating a flow of air and structure or a mechanism for directing that air across the contact surface. Preferably, the structure for directing air includes a hollow tube through which air passes, and having at least one aperture, which may be a hole, slit or other opening, through which a flow of the air can be exhausted. The aperture is preferably positioned so as to exhaust the flow of air in the direction of the contact surface.

In a preferred embodiment of the apparatus of the present invention, the volumetric flow rate of the flow of air through the tube is most preferably about 25 to 30 cubic feet per minute. In specific embodiments of the present apparatus wherein the contact surface has an area of about 6 to 10 square inches, the aperture in the tube will also preferably be a slit of a square or rectangular shape, having dimensions of about 1 to 4 inches in width and about ¼ to ½ inches in height.

The drying arrangement of the present apparatus is also capable of removing moisture from the finger, either in addition to removing moisture from the contact surface, or alternatively, when the finger held in proximity with the contact surface.

Other examples of a drying means useful in the present apparatus include, for example, means well known in the art which employ a desiccant, an evaporative liquid, or the like for moisture removal. Useful desiccants include, for example, silicas, magnesium or sodium sulfate alone or in mixture with inert carriers as well as diatomaceous earth and clays. Useful evaporative liquids include low molecular weight alcohols, ketones, and ethers and the like which can leach or extract water or water-based moisture from a surface and which rapidly evaporate at typical room temperature. In a preferred embodiment, these alternative drying means can be placed in proximity with the contact surface by locating an open container holding the drying means adjacent the contact surface. The finger is wiped across the drying means and preferably in a continuous movement is transferred to the contact surface.

The present invention provides a method for preparing a finger for optical fingerprint image processing. The method includes the steps of providing a fingerprint image processing apparatus as described hereinabove, and exhausting a flow of air from the drying means in the direction of the contact surface, so as to evaporate moisture therefrom, or from a finger held in proximity with the contact surface, or from both.

The moisture which is removable by the present method is typically human perspiration, sweat, water or other evaporable liquid. Loose soil or other particulate matter present on the finger may incidentally be removed by the force of the flow of air. Typically, when the flow rate of the air stream is about 25 to 30 cubic feet per minute, a period of time of less than about one or two seconds is sufficient for removing all or substantially all moisture from the finger prior to placement of the finger on the contact surface.

DETAILED DESCRIPTION OF THE PREFERRED EMBODIMENTS

Figure 1:
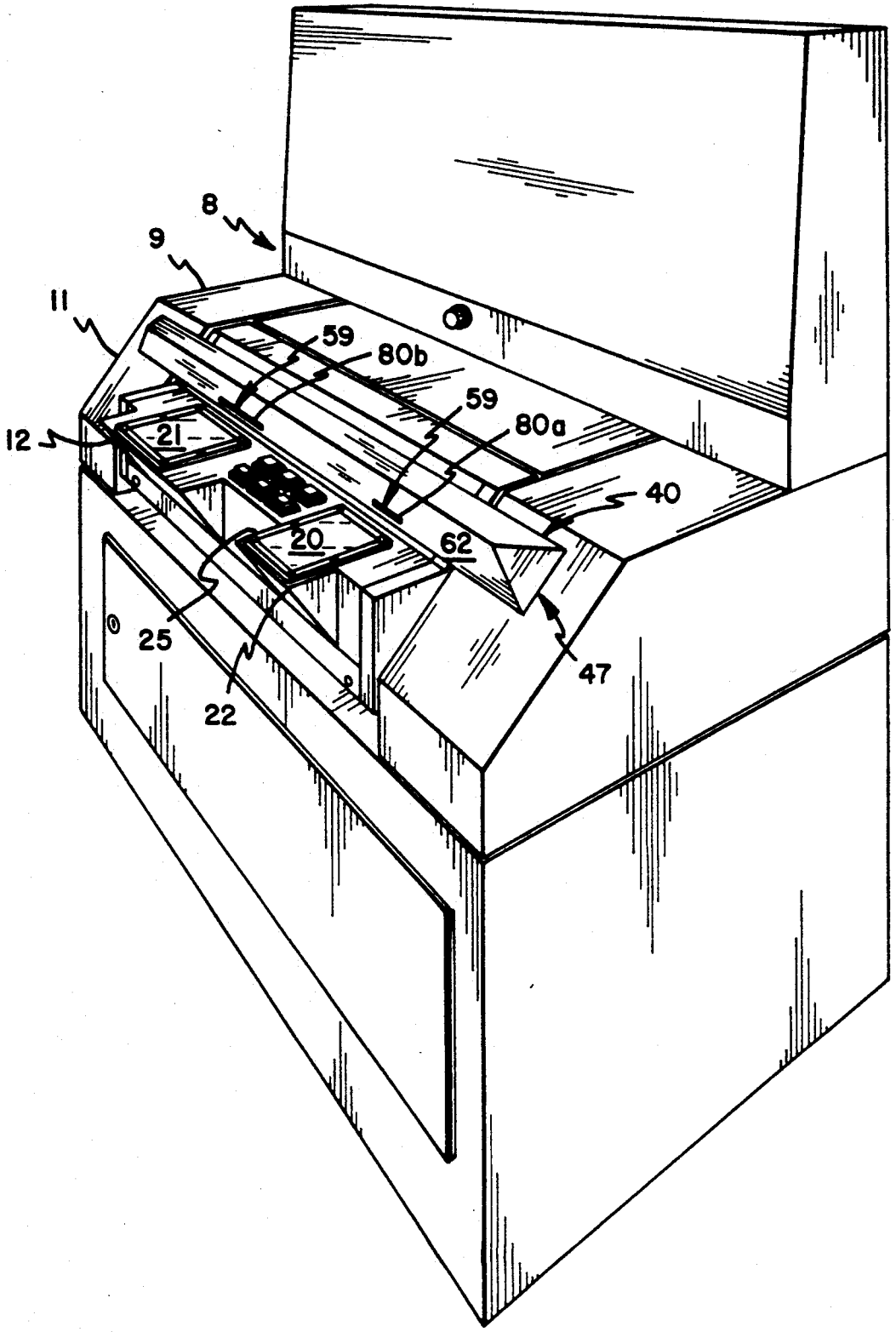
FIG. 1 is an elevated perspective view of an apparatus constructed according to the preferred embodiment of the present invention.

Referring now to the drawings, wherein like reference numerals designate corresponding elements throughout the views and particularly referring to FIG. 1, a fingerprint image processing system 8 is shown. The fingerprint image processing system 8 includes a device for imaging 9 that may be any one of a number of known imaging apparatus. For instance, the apparatus may be an optical image processing system, such as that described by Digital Biometrics, Inc. as Model No. 1133R. The imaging device 9 has a housing 11 which generally encloses the scanning and image processing equipment. The housing 11 has a front portion 12 on which is mounted at least one image-projecting, or "contact", surface upon which a person being fingerprinted places a finger or fingers. The embodiment illustrated in FIG. 1 includes two such surfaces 20 and 21 which are sized for placement of all fingers and one finger respectively. The remainder of the Detailed Description focuses largely on surface 20, but it is to be understood that surface 21 is substantially similar to surface 20, but for minor differences which will be noted.

The surface 20 is preferably one side of a hard plastic prism. An image of the fingerprint of the finger resting on the surface 20 is projected through the prism 22 and is scanned and recorded by the internal image processing system (not shown) in a known manner. Contact surface 20 is preferably mounted in housing 11 by a frame 25, illustrated in FIGS. 1 and 2. That is, prism 22 is preferably fixed, such as by gluing or bolting, in frame 25, such that surface 20 is coplanar with, or does not protrude from, frame 25. Frame 25 is fixed to the housing 11 for instance by screws 28 through the frame 25 which extend into the housing 11.

Contact surface 20 is sized to accommodate a thumb or a single digit. In the embodiment illustrated in FIG. 1, the surface 20 is rectangular and is between about 2 inches×3 inches and 4 inches×4 inches. Surface 21 is somewhat larger than surface 20 and is sized to accommodate several fingers at one time. Surface 21 is between about 3 inches×3 inches and 5 inches×5 inches.

Image processing system 8 further includes a mechanism or arrangement 40 for drying the image-projecting surface 20 and/or for drying the finger(s) of a person being fingerprinted. The drying arrangement 40 is preferably located in close proximity to the surface so that the person being fingerprinted will have his or her finger dried as it is lowered onto the surface. Further, the drying arrangement is constructed and arranged to dry the finger and the contact surface 20 as the image of the fingerprint is scanned.

Figure 2:
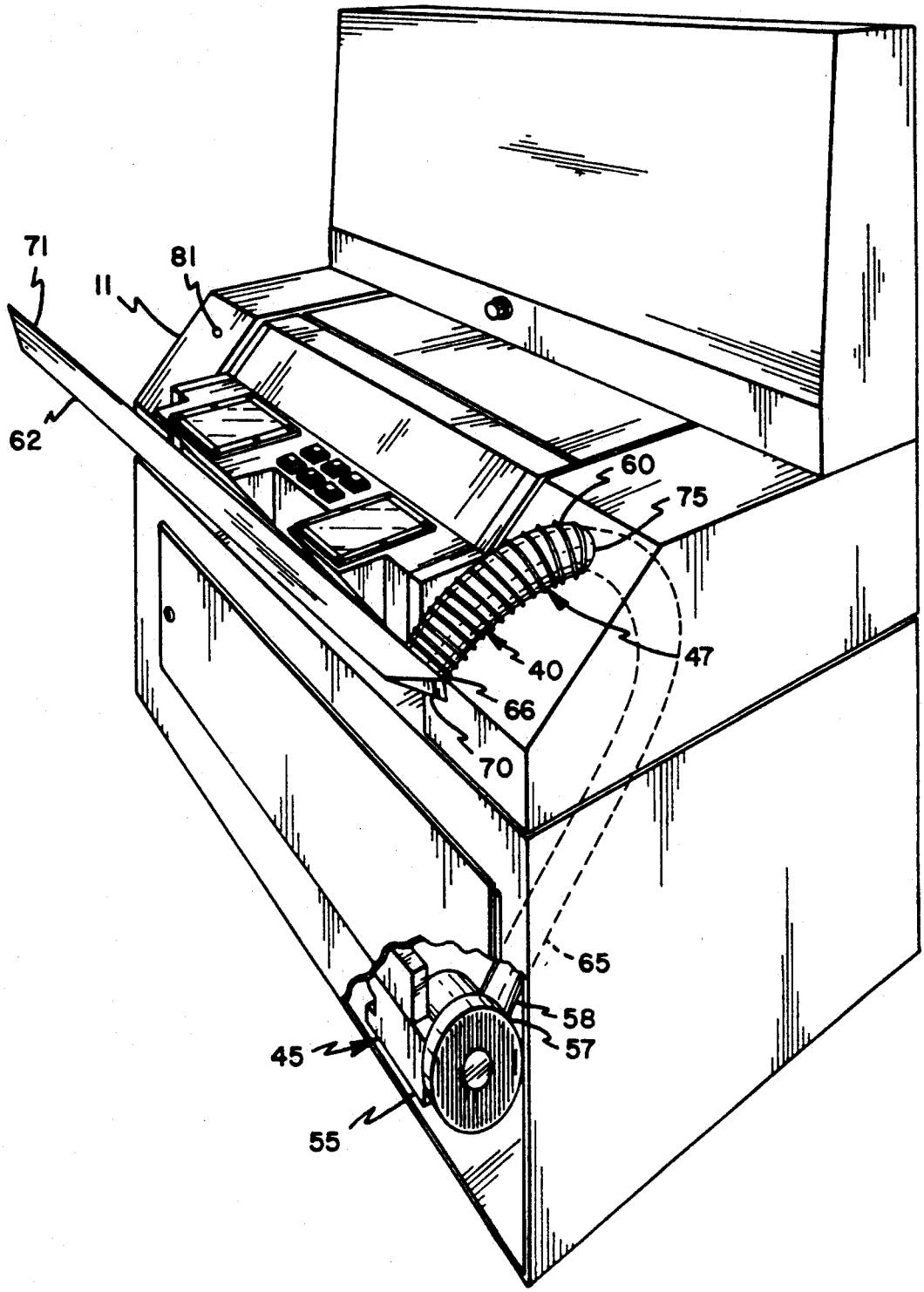
FIG. 2 is an elevated perspective view of the apparatus illustrated in FIG. 1, with a portion of the apparatus displaced from its typical in-use position, and with a portion of the apparatus shown in cutaway.
Figure 3:
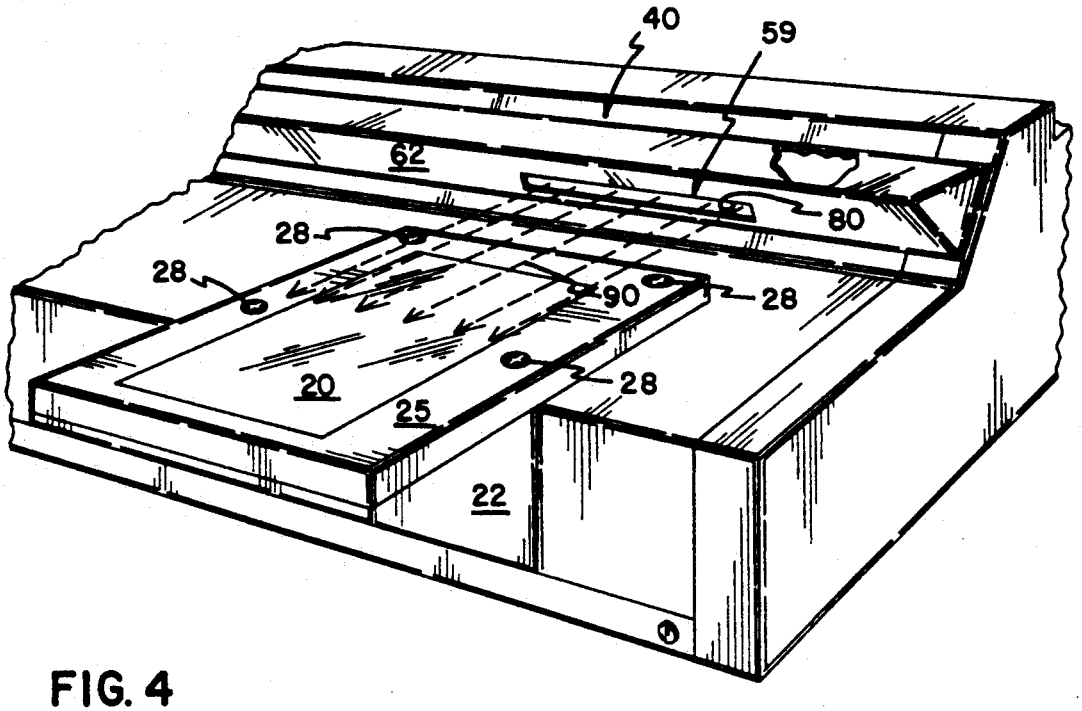
FIG. 3 is a partial, enlarged, elevated perspective view of the apparatus of FIG. 1.

In the most preferred embodiments indicated by FIGS. 1-3, drying arrangement 40 includes structure 45 for generating air flow and structure 47 for directing that air flow across the contact surface 20. In the embodiment illustrated in FIGS. 1-3, the structure 45 for generating air flow is a fan 55 or a blower, visible in FIG. 2. For convenience, the fan 55 is located in the bottom portion of housing 11. The fan 55 generates air flow and has an outlet 57 that is in fluid communication with the structure 47 for directing air flow across the image-projecting surface 20.

In the most preferred embodiment, illustrated in FIGS. 1-3, the structure 47 for directing air flow from the fan to and across the image-projecting surface 20 includes an inlet 58 and an outlet 59. The outlet 59 is visible in FIGS. 1 and 3. The inlet 58 is attached to and in fluid communication with the fan outlet 57. The air outlet 59 is located in relatively close proximity to the surface 20.

More specifically, the structure 47 for directing air flow includes a flexible hose 60 and a conduit 62. The hose 60, illustrated in FIG. 2, has first and second opposite ends 65 and 66, respectively. First end 65 engages and is attached to the fan outlet 57. The conduit 62 has first and second opposite ends 70 and 71, respectively. The second end 66 of hose 60 is attached to and in fluid communication with the first end 70 of conduit 62. Conduit 62 includes openings or apertures 80 through which the conduit 62 is in fluid communication with the atmosphere. In this manner, the air flow generated by fan 55 flows from fan outlet 57, is directed through hose 60 and conduit 62 and then is exhausted through apertures 80.

In the preferred embodiment, as illustrated in FIG. 2, hose 60 extends through an aperture or opening 75 of the housing 11. Conduit 62 is preferably elongated and substantially rigid. Structure is provided for attaching the second end 71 of conduit 62 to the housing 11 of the optical imaging device 9. Any conventional attachment means may be used to attach second end 71 of conduit 62 to the housing 15. In the embodiment shown, the attachment mechanism is a snap, with one portion of the snap (not shown) attached to the conduit second end 71 and the other portion 81 of the snap attached to the housing 17. Other attachment mechanisms including velcro or the like may be used as well. Further, the housing 11 may include structure for supporting the conduit 62 removably or permanently thereon.

As illustrated in FIG. 1, in typical use, the conduit 62 is supported at both ends and is secured to the housing 17, such that the conduit 62 extends substantially horizontally across the front of the housing 17. In the embodiment illustrated in FIGS. 1 and 2, the conduit 62 has an outwardly pyramid-type shape. That is, it is triangular in transverse cross-section. It is to be understood that the conduit 62 may be of any suitable shape.

As can be understood with reference to FIG. 1, apertures or slots 80 in conduit 62 are positioned in close proximity to image-projecting surface 20. Because the embodiment in FIG. 1 includes two contact surfaces 20 and 21, two respective slots 80*a* and 80*b* are provided. That is, a first slot 80*a* is positioned adjacent image-projecting surface 20; aperture or slot 80*b* is positioned adjacent image-projecting surface 21. Each aperture or slot 80 is sized, shaped, and oriented to direct air flow toward and across its associated surface 20. This is illustrated in FIG. 3. Arrows 90 indicate the direction of air flow across the surface 20 in the most preferred manner. In the most preferred embodiment, the slot 80 is rectangular-shaped and is between about 1 and 4 inches in width, with a height of between about ¼ to ½ inches. For a surface 20 having a width of between about 1.5 to 2 inches, slot 80 preferably has a width of between about 1.5 to 1.7 inches, and is spaced about 1 or 1.1 inches from the nearest edge of the surface 20. Most preferably, for a surface 20 having a width of 1.9 inches, slot 80 has a width of about 1.625 inches, and is spaced about 1.05 inches from the nearest edge of the surface 20.

Further, in the most preferred embodiment, the air flow from the fan, and the size of apertures or slots 80 are such that the volumetric flow rate from each slot is approximately 27 cubic feet per minute. It has been found that this volumetric flow rate is adequate to dry a suspect's finger in less than about three seconds and preferably within one to two seconds when placed in the path of the air flow. Further, the diameters of hose 60 and conduit 62 are preferably such as to minimize pressure drop between the fan and the slots 80.

Figure 4:
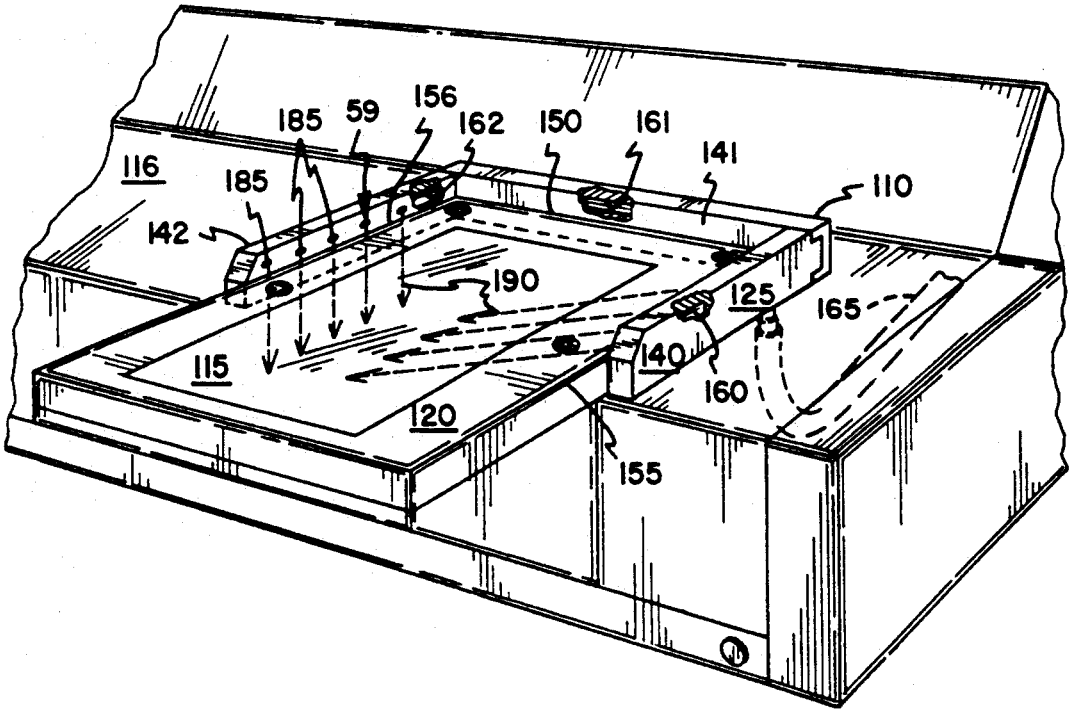
FIG. 4, is a partial, enlarged, perspective view of an alternate embodiment of a portion of the apparatus illustrated in FIG. 1.
Figure 5:
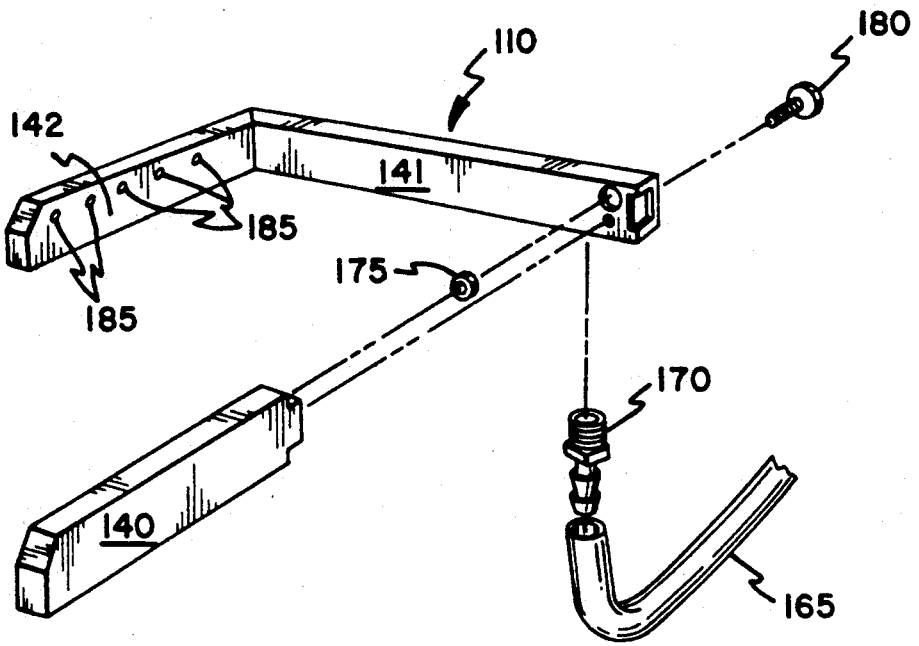
FIG. 5 is an exploded, assembly view of a portion of the portion of the apparatus illustrated in FIG. 4.

A second embodiment of an air flow directing structure is shown as air flow directing structure 110 in FIGS. 4 and 5. Contact surface 115 is mounted to the housing 116 of the image processing system by a mounting frame 120 in a manner substantially similar to the mounting of surface 20 in housing 11 described above. In this alternate embodiment, contact surface 115 is partially surrounded by a conduit frame 125. The conduit frame 120 includes three segments 140, 141 and 142. The segments 140, 141 and 142 are generally elongate members joined to one another at their ends, at right angles, as illustrated in FIG. 4. The segments 140–142 are of appropriate length to abut one end 150 and portions of adjacent sides 155 and 156 of the mounting frame 120.

Referring now to FIG. 5, it will be understood that the segments 140–142 are in fluid communication. That is, each of the segments 140–142 includes a passage 160, 161 and 162, respectively, therethrough, and the passages 160, 161 and 162 are in fluid communication with one another. The conduit frame 125 is connected to a fan (not shown) through a tube 165. As illustrated, in FIG. 5, tube 165 is attached to segment 151 with a hose barb union 170. An O-ring 175 is positioned between segments 140 and 141 to enhance a fluid-tight seal between passages 160 and 161. Similarly, an O-ring (not shown) is disposed between segments 141 and 142 to enhance a fluid-tight seal between passages 161 and 162. Segment 160 is secured to segment 161 with, for instance, a screw 180 passing through a portion of segment 141 and into a portion of segment 140. In the preferred embodiment, the screw 180 does not interfere with the air passages 160 and 161. Segment 142 is secured to segment 141 in a similar manner.

As illustrated in FIGS. 4 and 5, segment 142 includes a plurality of apertures 185 in fluid communication with passage 162. The apertures 185 are positioned on the side of segment 142 adjacent to the contact surface 115. Similarly, segment 140 includes apertures (not shown) in fluid communication with passage 160. Apertures 185 and the apertures in segment 140 are constructed and arranged to direct air toward the contact surface 115. Most preferably, the air is directed in an angled fashion as illustrated by the arrows 190 in FIG. 4.

Most preferably, the number of apertures 185, the cross-sectional area of apertures 185, and the volumetric flow rate produced by the fan cooperate such that the combined flow rate from the apertures is between about 25 and 35 cubic feet per minute.

In the embodiment illustrated in FIGS. 4 and 5, apertures 185 are generally circular in cross-section. It is to be understood, however, that other shapes and constructions of apertures are contemplated. For instance, rectangular slots may be employed in the segments 140 and 142. Additionally, apertures, holes, or slots, may be included on segment 141 directed toward the image-projecting surface 115.

This invention further includes a method of preparing a finger for optical fingerprint image processing. The preferred method includes drying the finger or fingers to be scanned immediately prior to scanning the finger. Additionally or alternatively, the method includes drying the finger during scanning. Additionally or alternatively, the method includes drying the contact surface prior to and during scanning.

More specifically, the method includes exhausting a flow of air across the surface upon which the finger of the person being fingerprinted will rest while being scanned. As the finger is lowered onto the contact surface, the air flow will dry the finger. Further, the air flow may continue to dry the finger as the finger rests on the surface during scanning. Still further, the air flow may dry the contact surface prior to and/or during scanning.

The invention has been described with reference to various specific and preferred embodiments and techniques. However, it should be understood that many variations and modifications may be made while remaining within the spirit and scope of the invention.

We claim:

1. A fingerprint image processing apparatus comprising:

(a) a means for imaging having a contact surface adapted to receive a finger thereon; and (b) a drying means mounted on said imaging means in proximity with said contact surface, said drying means adapted for removing moisture from said contact surface and from a finger which is in proximity with said contact surface by directing a flow of air across said contact surface.

2. An apparatus of claim 1 wherein said drying means comprises a means for supplying said air flow across said contact surface.

3. An apparatus of claim 2 wherein said apparatus further comprises a fan attached to said imaging means, wherein said means for supplying air flow comprises a tube connected to said fan and having at least one aperture positioned so as to exhaust a flow of air therefrom in the direction of said contact surface.

4. An apparatus of claim 3 wherein a volumetric flow rate of said flow of air is about 25–30 cubic feet per minute.

5. An apparatus of claim 3 wherein a surface area of said contact surface is about 6–16 square inches.

6. An apparatus of claim 3 wherein said at least one aperture is a slit which is rectangular in shape.

7. An apparatus of claim 6 wherein said slit has a length of about 1–4 inches and a height of about $\frac{1}{2}$–$\frac{1}{4}$ inches.

8. An apparatus of claim 1 wherein said moisture comprises human perspiration.

9. A method of preparing for fingerprint image processing, comprising the steps of:

(a) providing a fingerprint image processing apparatus comprising a means for imaging having a contact surface adapted to receive a finger thereon, and a drying means mounted on said imaging means in proximity with said contact surface, said drying means adapted for removing moisture from said contact surface or from a finger which is in proximity with said contact surface by directing a flow of air across the said contact surface; and (b) exhausting a flow of air from said drying means so as to evaporate moisture from said contact surface.

10. The method of claim 9, wherein said moisture comprises human perspiration.

11. The method of claim 9, wherein a volumetric flow rate of said flow of air is about 25–30 cubic feet per minute.

12. The method of claim 11, wherein said evaporation is accomplished during a period of time which is less than about three seconds.

13. A fingerprint image processing apparatus comprising:

(a) a means for imaging having a contact surface adapted to receive a finger thereon; and (b) a drying means mounted on said imaging means and in proximity with said contact surface, said drying means comprising fluid flow directing means for directing a flow of a fluid across said contact surface.

14. An appartus of claim 13 wherein the fluid flow directing means comprises an air flow directing structure which can be used to direct a flow of air across said contact surface.

15. An apparatus of claim 14 wherein the fluid flow directing means further comprises a fan connected to said imaging means and wherein the air flow directing structure comprises a tube in fluid connection with said fan and having an aperture positioned so as to exhaust a flow of air therefrom in the direction of said contact surface.

* * * * *

UNITED STATES PATENT AND TRADEMARK OFFICE

CERTIFICATE OF CORRECTION

PATENT NO. : 5,249,370

DATED : October 5, 1993

INVENTOR(S) : Bruce N. Stanger et al.

It is certified that error appears in the above-identified patent and that said Letters Patent is hereby corrected as shown below:

Column 6, line 7, please delete "120" and insert therefor --125--.

Column 6, line 21, please delete "151" and insert therefor --141--.

Signed and Sealed this

Fourteenth Day of June, 1994

Bruce Lehman

*Attest:*

BRUCE LEHMAN

*Attesting Officer*

*Commissioner of Patents and Trademarks*